US010450764B2

(12) United States Patent
Woodford

(10) Patent No.: US 10,450,764 B2
(45) Date of Patent: Oct. 22, 2019

(54) APPARATUS AND METHOD FOR STRAIGHTENING AND/OR PUSHING A WALL

(71) Applicant: Woodford Bros., Inc., Apulia Station, NY (US)

(72) Inventor: Michael Woodford, Fabius, NY (US)

(73) Assignee: Woodford Bros., Inc., Apulia Station, NY (US)

( * ) Notice: Subject to any disclaimer, the term of this patent is extended or adjusted under 35 U.S.C. 154(b) by 0 days.

(21) Appl. No.: 15/902,493

(22) Filed: Feb. 22, 2018

(65) Prior Publication Data

US 2018/0245360 A1 Aug. 30, 2018

Related U.S. Application Data

(60) Provisional application No. 62/461,940, filed on Feb. 22, 2017.

(51) Int. Cl.

| | |
|---|---|
| ***E04G 23/02*** | (2006.01) |
| ***E04G 23/04*** | (2006.01) |
| ***E02D 37/00*** | (2006.01) |
| ***E02D 35/00*** | (2006.01) |
| *E04G 17/14* | (2006.01) |

(52) U.S. Cl.

CPC ..... *E04G 23/0229* (2013.01); *E02D 35/00* (2013.01); *E02D 37/00* (2013.01); *E04G 23/04* (2013.01); *E04G 17/14* (2013.01)

(58) Field of Classification Search

CPC ..... E04G 23/0229; E04G 23/04; E02D 35/00; E02D 37/00

See application file for complete search history.

(56) References Cited

U.S. PATENT DOCUMENTS

| | | | | |
|---|---|---|---|---|
| 4,261,548 A * | 4/1981 | Kaderabek | ..... | E02D 35/00 254/131 |
| 8,590,259 B2 * | 11/2013 | Trinko | ..... | E02D 17/04 405/230 |
| 2003/0190196 A1 * | 10/2003 | Lanka | ..... | E04G 21/26 405/272 |

* cited by examiner

*Primary Examiner* — Patrick J Maestri

(74) *Attorney, Agent, or Firm* — Bond Schoeneck & King, PLLC; George McGuire

(57) ABSTRACT

The present disclosure is directed towards an apparatus and method for straightening and/or shifting a wall that has bowed, deflected, or shifted out of place. The apparatus includes a vertical bar that is placed against the wall, a horizontal bar that is butted up against the wall and extends away from the wall, an adjustable length force-applying component that is situated diagonally between these two bars. The adjustable length force-applying component is extended to push the wall into a straight, vertical orientation and/or at the base.

3 Claims, 4 Drawing Sheets

APPARATUS AND METHOD FOR STRAIGHTENING AND/OR PUSHING A WALL

CROSS-REFERENCE TO RELATED APPLICATION

The present application relates and claims priority to Applicant's U.S. Provisional Patent Application, Ser. No. 62/461940, filed Feb. 22, 2017, the entirety of which is hereby incorporated by reference.

FIELD

This disclosure is directed towards an apparatus and method of construction repair, and more particularly for pushing a bowed or deflected wall, or one that has shifted at its base.

BACKGROUND

Walls can bow or shift laterally at the base due to water intrusion, excess pressure from one side of the wall, rust on steel lintels, damage to masonry lintel reinforcement, or other reasons. It is important to repair the wall so that it can retain its integrity.

Wall repair systems that are currently in use generally brace the wall in the deflected position preventing further bowing or shifting. These structures tend to be retained on the wall and are obvious repairs, therefore decreasing the visual appeal of the wall and likely reducing the property's value at resale. Bracing systems also exist for forming and pouring concrete replacement walls, but do not straighten the existing wall. Other current mechanisms that are available tend to not be able to shift a wall back into position that has sheared at the base.

There are several techniques available to straighten masonry walls. For example, US Patent Publication 2003/0192280 by Billante discloses a wall straightening device and method for installation. However, it requires that permanent hardware to be left in place to support the wall. Indeed, this and many other current wall straightening methods leave unsightly repair equipment permanently that can take up space in the house, building, or garden and/or reduce the property's resale value. U.S. Pat. No. 8,590,259 to Trinko et al. also describes a wall straightening method. However, this method is limited in that it does not include elements that allow the device to be locked into place for appropriate adjustment during the straightening procedure. This method is also limited to foundation walls that extend below the ground. Also, U.S. Pat. No. 4,353,194 to Norton discloses a method for straightening a structural member such as a wall, but only applies only to structural members that include an inner wall and an outer wall with a passageway in between the two. Thus, there is a need for an improved, adjustable wall straightening system that brings the wall back into position and allows the wall per se to be fortified to prevent future bowing, deflecting, buckling, shearing, and lateral movement at the base.

SUMMARY

In accordance with one aspect of the present invention, there is provided an apparatus for straightening a wall that includes a vertical bar that can be positioned against the wall, a horizontal bar connected to the vertical bar at or near the base of the vertical bar so that the two bars can pivot about one another, and an adjustable length force-applying component that is connected diagonally between said vertical bar and horizontal bar. The horizontal bar is configured in such a manner to enable the vertical bar to move across the horizontal bar and be locked into place at a desired location, thereby permitting adjustment or removal of the diagonal, force-applying bar.

In accordance with another aspect of the present invention, there is provided an apparatus to push a wall back into alignment that has shifted laterally at the base having sheared inwards. This apparatus includes a vertical bar that lies against the wall, a horizontal bar connected to the vertical bar so that it can pivot, and an adjustable length force-applying component that is connected diagonally between said vertical bar and horizontal bar. The horizontal bar includes a channel by which the vertical bar can slide, thereby enabling the vertical bar to move as necessary in operation along the length of the horizontal bar as well as lock into place at a plurality of locations along the channel. This becomes important when the force-applying diagonal bar lengthens and pushes the base of the sheared wall back into position.

In accordance with another aspect of the present invention, there is provided a method for straightening a wall that has bowed or deflected. This method utilizes an apparatus that includes a vertical bar that can be positioned against the wall, a horizontal bar connected to the base region of the vertical bar so that it can pivot, the pivot end butted against a portion of the wall with the other end extending away from the wall, and an adjustable length force-applying component that is connected diagonally between said vertical bar and horizontal bar at the appropriate position. The adjustable length bar can be lengthened or otherwise adjusted so that the vertical bar exerts force against the wall and operationally pushes the wall into a more correct, stable position.

In accordance with another aspect of the present invention, there is provided a method for shifting a wall that has sheared at the base. This method utilizes an apparatus that includes a vertical bar that can be positioned to lay against the wall, a horizontal bar connected to the vertical bar at its base region so that the joint can pivot and also so that the vertical bar can slide across the horizontal bar, the pivot end butted against the wall and fixed with the other end extending away from the wall, and an adjustable length force-applying component that is connected diagonally between said vertical bar and horizontal bar. The adjustable length bar is lengthened so that the vertical bar pushes the wall at the base.

These and other aspects of the present invention will become apparent upon a review of the following detailed description and the claims appended thereto.

DETAILED DESCRIPTION

Figure 1:
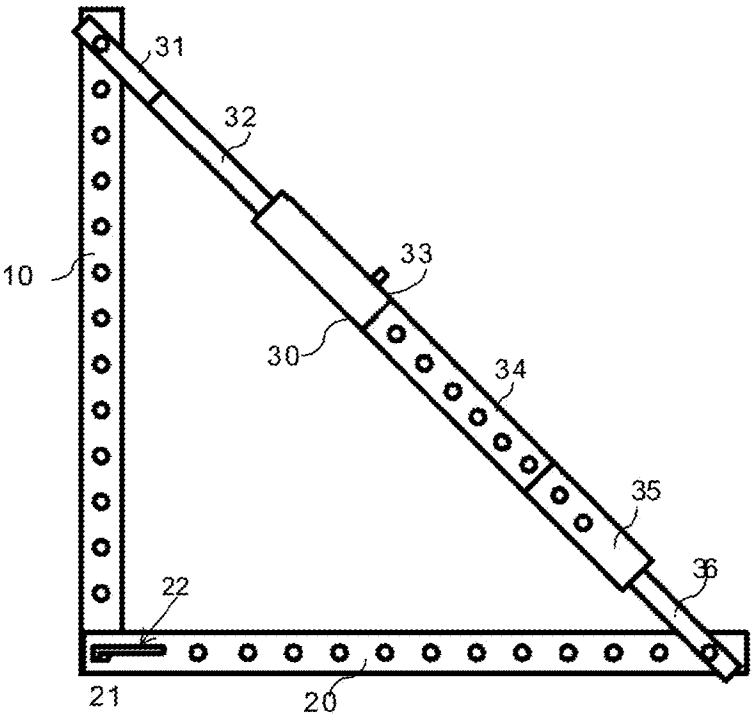
FIG. 1 shows the wall straightening system according to one embodiment of the invention. The components of the apparatus include a vertical C channel, a horizontal C channel, and a diagonal, adjustable length bar. These channels and bars are connected via pivot points.

The present disclosure advantageously addresses two problems associated with deteriorated construction: the first is an apparatus and method to push a bowed/deflected wall back to its original geometry. The second is an apparatus and method to push a wall back into alignment that had shifted at its base laterally from having sheared inwards.

The system employs the use of three components that can be configured in two ways, first:

a. A vertical bar, for example a C channel, that is placed against the defected wall.

b. A horizontal bar, for example a C channel, that is attached to the vertical bar that allows it to pivot at the connection. This bar gets its pivot end butted against the wall with the other end extending away from the wall. This piece is secured to the floor.

c. An adjustable length force-applying component that gets attached to the horizontal bar and to the vertical bar that allows each connection to pivot. The diagonal bar gets connected to the vertical bar just below the horizontal crack in the wall or, for shifting a sheared wall, at approximately the point where the wall has sheared from the base.

In one embodiment of the invention, the location where the vertical bar attaches to the horizontal bar includes a mechanism that enables the vertical bar to slide along the horizontal bar. This sliding motion allows one to more easily shift a sheared wall at the base back into its original position. This mechanism could be a channel in the horizontal bar through which the vertical bar slides, a collar attached to the vertical bar through which the horizontal bar slides, or other suitable mechanisms. This mechanism may include one or more ways to lock the vertical bar into place. For example, there could be a C-shaped locking mechanism (See FIG. 2A), holes into which a pin is inserted (FIG. 2B), a ratcheting mechanism (FIG. 2C), or any other suitable mechanism. It should be understood that the orientation of this locking mechanism is not important; the channel can lie in the plane of the apparatus, perpendicular to the apparatus, or any orientation that allows locking to occur. The locking mechanism allows the adjustable length force-applying component to be removed or adjusted during the process of pushing the wall.

The adjustable length bar can be adjustable and/or apply force via a hydraulic ram, a screw-based device, or any other suitable mechanism.

When the wall that is being pushed is a foundation wall, retainer wall, or a wall that otherwise lies against a reservoir of soil or the like, pushing the wall back into position benefits from excavation of soil away from the foundation prior to straightening. It is generally recommended that the bracing be erected prior to excavation to help secure the wall while the digging is being done.

In a working embodiment of the invention, wood planks (or other suitable material) are stacked flat against the wall to distribute the horizontal thrust created across the surface of the masonry. Accordingly, there could be a plurality of braces along the wall. More or fewer braces can be used based on the wall's size and severity of how much it has deflected.

To facilitate the use of the embodied system, it is recommended that any pointing that had occurred previously in an effort to make cosmetic repairs be removed prior to the straightening procedure. For example, it is recommended to grind out the fill material then blow any remaining debris away in order to allow the wall to return its original position. This step is important because the fill material will likely resist straightening.

With the components arranged and ready to begin the straightening, it is recommended to utilize external monitoring of the wall shift as the interior is obscured by the system itself.

In order to push the wall, each brace should be manipulated at the same time or in a wave-like fashion moving to each brace and adjusting it incrementally to make the wall move uniformly. A typical bowed wall has usually shifted more in the middle then at the ends. It is thus recommended that the braces in the area with the most severe displacement be manipulated first, or as appropriate given the wall's geometry and conditions.

With the wall returned to plumb, it may be advantageous to install reinforcement to fortify its integrity and keep it straight. There are a number of solutions including: epoxied straps installed at the interior, wall anchors (plates installed on the interior with a steel rod extending to an anchor installed exterior to hold it), power braces (steel I beams installed along the interior), rebar installed into the block walls cores then a high strength grout pumped into the cores to set up internally and provide the needed structural integrity, or other suitable reinforcement needs.

Because water infiltration is a common cause of wall deflection, it is generally recommended to assess the runoff conditions to see that water is being managed correctly. A common cause for such wall movement is hydrostatic pressure, and this problem can be addressed as necessary at this time.

Another working embodiment of the invention includes an apparatus and method to push a wall that has shifted at its base laterally by manipulating it outward to return the wall to its original position. The components are as follows:

a. A vertical bar, for example a C channel, that lies against the wall.

b. A horizontal bar, for example a C channel, that is attached to the vertical bar that allows the vertical bar to slide along a channel at the connection. The slide end is butted against the wall with the other end extending away from the wall. This piece is secured to the floor, for example with wedge bolts. Optionally, the channel on the horizontal bar includes a mechanism so that the vertical bar can be locked into place at one or more locations along the channel.

c. An adjustable length force-applying component that is attached to the horizontal bar and to the vertical bar that allows each connection to pivot, thus forming a diagonal bar. The diagonal bar is connected to the vertical bar just above the bottom of the lowest block that shifted.

In one embodiment of the invention, the pivot point at which the vertical bar attaches to the horizontal bar includes a mechanism that enables the vertical bar to be adjustably moved/positioned along the horizontal bar. This enables a wall sheared at its base to be pushed back into its original position. This mechanism may include one or more structures to allow the vertical bar to move some distance along the horizontal bar, which is fixed secured in place, and to lock the vertical bar into place at a desired position. For example, there could be a C-shaped locking channel (See FIG. 2A), holes into which a pin is inserted (FIG. 2B), a ratcheting mechanism (FIG. 2C), or any other suitable mechanism.

The adjustable length bar can be adjustable and/or apply force via a hydraulic ram, a screw-based device, or any other suitable mechanism.

Optionally, it may be advantageous to have wood planks stacked flat against the masonry wall to distribute the horizontal thrust created across the surface of the masonry.

When the wall that is being pushed is a foundation wall, retainer wall, or a wall that otherwise lies against a reservoir of soil or the like, shifting the wall at the base may benefit from the excavation of soil away from the foundation prior to straightening. It is generally recommended that bracing be erected prior to excavation to help secure the wall while the digging is being done.

This system generally benefits from the use of sufficient planking to distribute the horizontal thrust loads imposed against the wall that are necessary to straighten the wall. Thus, in one embodiment, there are a plurality of braces along the wall. More or fewer braces can be used based on the wall's size and severity of how much it has shifted.

With the components arranged and ready to begin the straightening, it is recommended to utilize external monitoring of the wall shift as the interior could be obscured by the system itself.

To accomplish the procedure, it is recommended that each brace be manipulated at the same time or work in a wave-like fashion moving to each brace and adjusting it incrementally to move the wall uniformly.

The invention will be further illustrated with reference to the following specific examples. It is understood that these examples are given by way of illustration and are not meant to limit the disclosure or the claims to follow.

EXAMPLE 1

Wall Straightening System

In the following example, one embodiment of the wall straightening system is described. FIG. 1 shows the main components of the system. There is a vertical C channel (10), a horizontal C channel (20), and an adjustable length ram (30). In this example, the vertical C channel is approximately 7 ft long and includes holes approximately 6 inches apart extending along the length to accommodate bolts for attachment of the adjustable length ram 30. It must be understood that this channel (10) pivotally connects at its end to the end of the horizontal C channel (20) so that in practice this channel does not always assume a vertical position but could move to contour the floor even if it is sloped. In this example, the horizontal C channel (20) is approximately 9.8 ft long and also includes holes along its length to accommodate bolts for attachment of the adjustable length ram. It is secured to the concrete floor with wedge bolts. The adjustable length ram (30) includes a solid pipe with connector (31), which is bolted to the vertical C channel so that the channel and bar can pivot, and, for example, could be approximately 8 in long. Also included in the adjustable length ram (30), on the side of the pipe (31) opposite the vertical C channel (10), there is an effective ram (32) that is approximately 6-24 in, then a hydraulic ram body (33) that is approximately 30 in. The hydraulic ram body includes a valve to which an air pump is connected; this allows air to be pumped into the ram so that it will increase in length and push the wall back into a vertical alignment. Adjacent to the hydraulic ram body is an inner sleeved pipe on pipe (34), which is approximately 24 in. This inner sheered pipe is encased in an outer sleeved pipe on pipe (35), approximately 20 in. The inner—(34) and outer—(35) sleeved pipe-on-pipe configuration allows the ram to be adjustable in length. Connected to the other end of the outer sleeved pipe on pipe (35) is another solid pipe with connector (36), approximately 8 in, which is in turn bolted to the horizontal C channel (20). The bolt allows pivot between the horizontal C channel (20) and the adjustable-length ram (30).

EXAMPLE 2

Figure 2A:
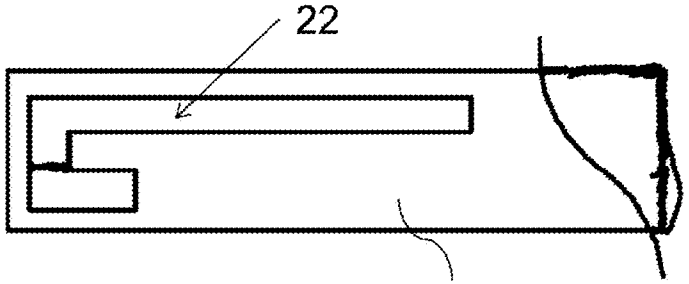
FIG. 2A shows a C-shaped locking mechanism.
Figure 2B:
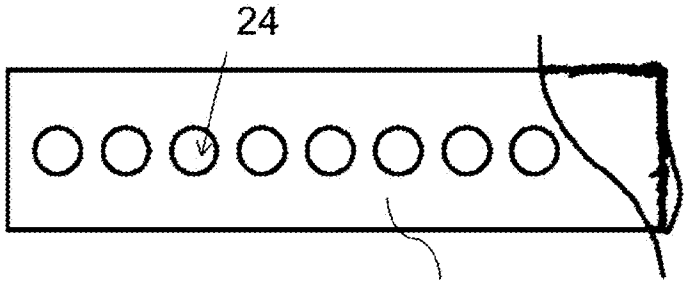
FIG. 2B shows holes through which a pin can be inserted.
Figure 2C:
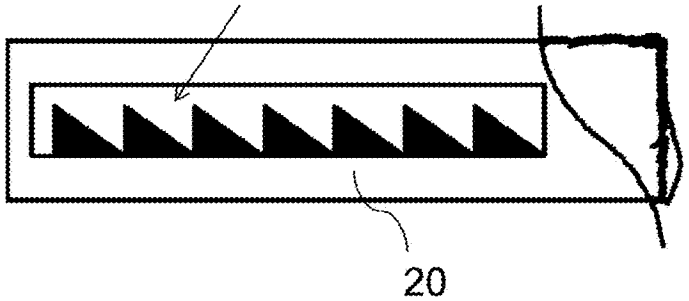
FIG. 2C shows a ratcheting locking mechanism with saw teeth.

Apparatus for Pushing a Wall Back into Place that has Shifted Laterally at its Base This section describes one example of an apparatus that can be used to push a wall back into place that has shifted laterally at the base. The components are similar to what was described in Example 1, although the horizontal C channel 20 is specialized to include a channel by which the vertical C channel can slide. FIG. 2A illustrates one example of the slide channel. The channel is approximately 2⅛ in wide and includes a slit 22 that is approximately ½ in wide. The slit includes two right angles—it extends towards the wall for approximately 6 in, makes a right angle and extends for approximately 1 in (close to and parallel to the wall), and then makes another right angle to extend away from the wall for approximately 1 in. The configuration of this channel allows the vertical bar to be locked into place. Alternatives to the C-shaped channel 22 could include a plurality of holes 24 into which a pin is inserted (FIG. 2B), a ratcheting mechanism 26 (FIG. 2C), or any other suitable mechanism.

EXAMPLE 3

Figure 3A:
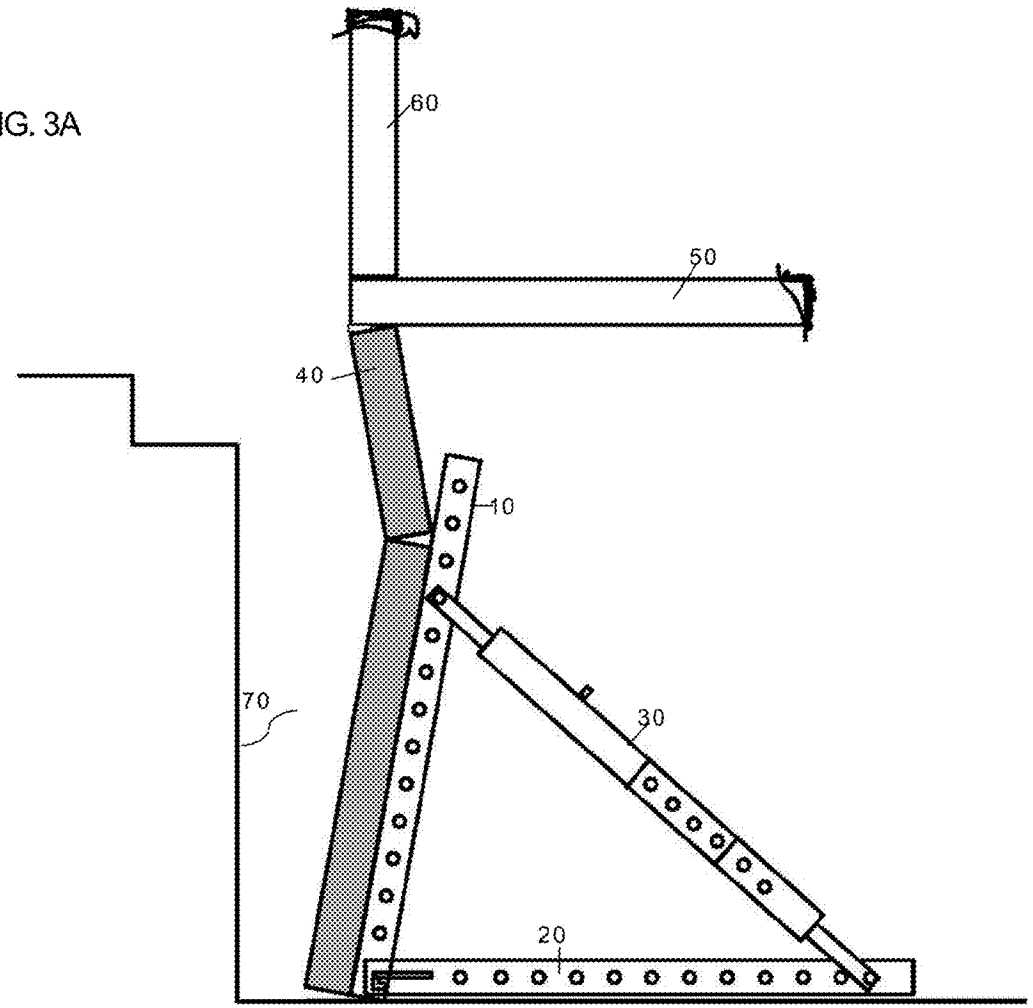
FIG. 3A shows the apparatus against the bowed wall before it is straightened.

Method of Straightening a Foundation Wall Using the Wall Straightening System FIG. 3 illustrates an example of the wall straightening method in practice. In FIG. 3A, the wall straightening device has been situated so that the vertical C channel (10) is lying against a bowed foundation wall (40) and the horizontal C channel (20) is on the concrete basement floor. The foundation wall 40 is supporting the ceiling to the basement/floor of the first floor of the building (50), and a wall of the building (60). Earth has been excavated on the outside of the building (70) in order to monitor the straightening process.

As part of the disclosed method, air is pumped into the hydraulic ram and the adjustable length ram 30 increases in length so that the angle between the vertical and horizontal C channels increases. The attachment point of the adjustable length ram (30) to the vertical C channel (10) and the horizontal C channel (20) can be altered as appropriate during the straightening process. Lengthening of the adjustable length ram 30 continues until the angle between the vertical and horizontal C channels is 90° and the wall assumes a straight, vertical position.

EXAMPLE 4

Method of Returning a Wall Back into Position that has Sheared at the Base

Figure 3B:
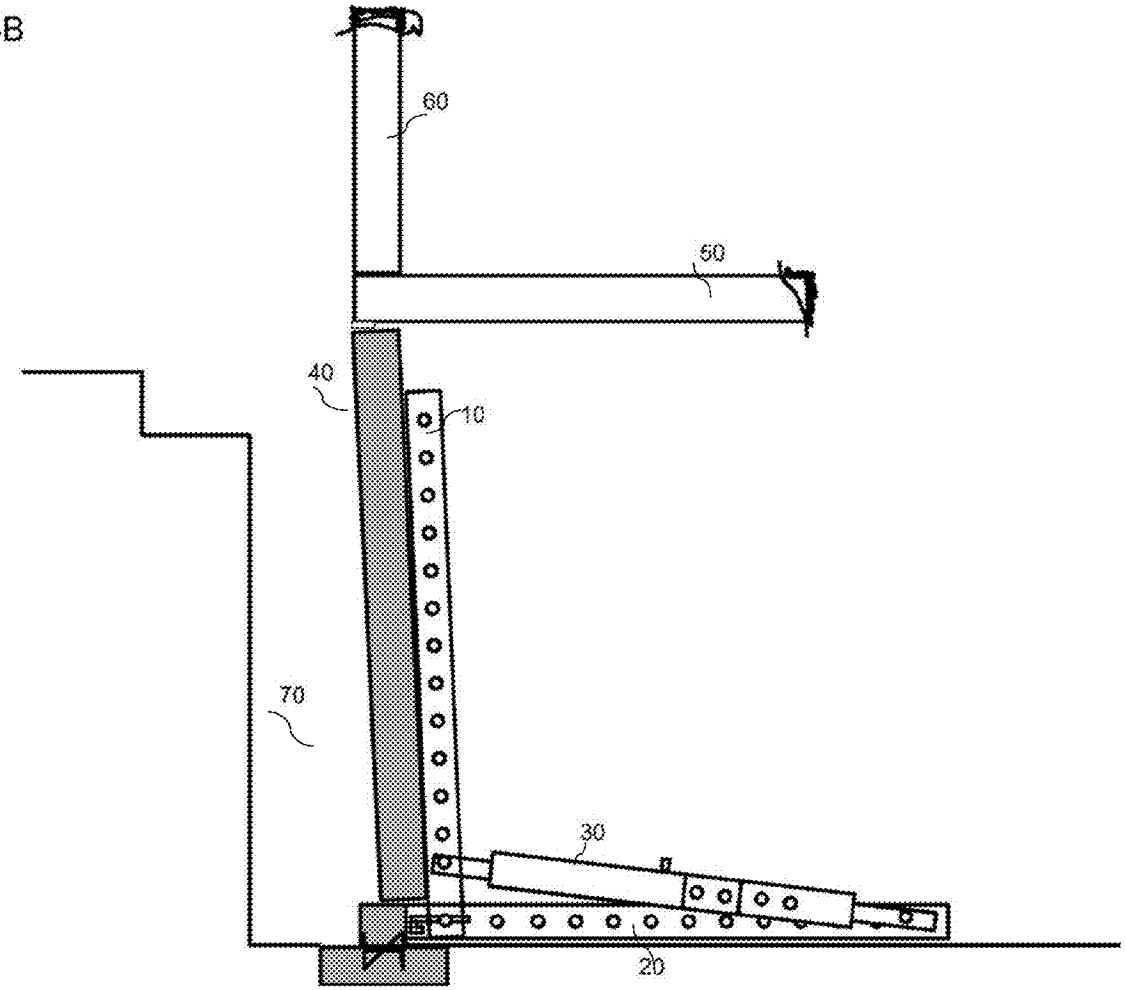
FIG. 3B shows the apparatus being used to shift a wall that had shifted at its base.

FIG. 3B illustrates an example of how the present disclosure is used to push a wall 40 back into position that has shifted at the base. The attachment point of the vertical bar (10) to the horizontal bar (20) includes a slit 22 by which the vertical bar (10) can slide within the channel of the horizontal bar (20) but can also be locked into many positions along the channel. The adjustable, force-applying bar (30) is bolted to the horizontal bar (20) at the far point from the foundation wall (40), and it is bolted to the vertical bar (10) at the bottom of the lowest sheared block. As the adjustable bar is extended, thereby applying force to the bottom of the wall, the vertical bar moves along the slit in the horizontal bar until the base of the wall is in the desired position.

Although various embodiments have been depicted and described in detail herein, it will be apparent to those skilled in the relevant art that various modifications, additions, substitutions, and the like can be made without departing from the spirit of the invention and these are therefore considered to be within the scope of the invention as defined in the claims which follow.

What is claimed:

1. An apparatus for straightening or pushing a wall, comprising:

a. a vertical wall-straightening component, b. a horizontal wall-straightening component pivotally connected to the vertical wall-straightening component and having a lockable length adjustable mechanism in which the vertical wall-straightening component is positioned for movement there-within, and c. an adjustable length force-applying component attached to both the vertical wall-straightening component and the horizontal wall-straightening component, wherein said vertical wall-straightening component is adapted to move within the length adjustable mechanism and said length adjustment mechanism comprises a slot formed in said horizontal wall-straightening component, said slot comprising a first length adjusting segment and a locking segment offset from and parallel to said length adjusting segment.

2. The apparatus of claim 1, wherein said adjustable length force applying component comprises an air powered ram.

3. An apparatus for straightening or pushing a wall, comprising:

a. a vertical wall-straightening component, b. a horizontal wall-straightening component pivotally connected to the vertical wall-straightening component and having a lockable length adjustable mechanism in which the vertical wall-straightening component is positioned for movement there-within, and c. an adjustable length force-applying component attached to both the vertical wall-straightening component and the horizontal wall-straightening component, wherein said vertical wall-straightening component is adapted to move within the length adjustable mechanism and said length adjustment mechanism comprises a ratchet formed in said horizontal wall-straightening component.

* * * * *